US006446462B1

(12) United States Patent
Kiyokawa et al.

(10) Patent No.: US 6,446,462 B1
(45) Date of Patent: Sep. 10, 2002

(54) FREEZING APPARATUS

(75) Inventors: Yasunori Kiyokawa; Yoshinori Noboru; Kazuyoshi Sugimoto; Takashi Sato; Jyunichi Suzuki; Kenji Aida, all of Osaka-fu (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 0 days.

(21) Appl. No.: 09/899,414

(22) Filed: Jul. 5, 2001

(30) Foreign Application Priority Data

Jul. 7, 2000 (JP) ..... 2000-207158
Jul. 7, 2000 (JP) ..... 2000-207164

(51) Int. Cl.[7] ..... F25B 1/10
(52) U.S. Cl. ..... 62/469; 62/510
(58) Field of Search ..... 62/84, 192, 193, 62/468, 469, 473, 510

(56) References Cited

U.S. PATENT DOCUMENTS 3,785,169 A * 1/1974 Gylland ..... 62/468
5,094,598 A * 3/1992 Amata et al. ..... 417/533
5,150,586 A * 9/1992 Basseggio ..... 62/468
5,327,997 A * 7/1994 Nash et al. ..... 184/6.4
5,586,450 A * 12/1996 Tollar et al. ..... 62/192
5,911,289 A * 6/1999 Waller ..... 184/103.2

* cited by examiner

*Primary Examiner*—William C. Doerrler
(74) *Attorney, Agent, or Firm*—Weingarten, Schurgin, Gagnebin & Lebovici LLP

(57) ABSTRACT

It is desired to avoid lack of lubricant oil in any of a plurality of compressors disposed in parallel in a single refrigerant circuit. To achieve this result, a freezer unit is provided, wherein a first kind of oil return pipe leading to a refrigerant suction pipe of a first compressor from an oil separator installed in a discharged refrigerant junction pipe is installed, and a second kind of oil return pipe leading to a refrigerant suction pipe of a second compressor from the regular oil level height of the first compressor 1 is utilized.

11 Claims, 4 Drawing Sheets

FREEZING APPARATUS

BACKGROUND OF THE INVENTION

1. Field of the Invention

The present invention concerns a freezer unit (including air conditioner) composed by providing a plurality of compressors for compressing refrigerant in parallel.

2. Detailed Description of the Prior Art

In general, the lubricant oil (called simply oil, hereinafter) that the compressor holds is discharged from the compressor with compressed refrigerant, lowering the oil level in the compressor and the lubrication becomes insufficient; therefore, an oil separator is installed in the refrigerant discharge pipe, in a way to return oil separated from refrigerant by this oil separator.

On the other hand, in a freezer unit connecting in parallel a plurality of compressors provided with a oil reservoir section in the low pressure portion, oil quantity balance is maintained by communication respective oil reservoir sections through an oil balance pipe.

However, in case of freezer unit wherein oil quantity balance is maintained by communication respective oil reservoir sections through an oil balance pipe, when at least one of compressors is a capacity controllable compressor, or, when a plurality of compressors of different compression capacity are connected in parallel for enlarging the scale, oil increases in the high output compressor, oil lacks in the low output compressor, abrasion progresses at the sliding parts of oil lacking compressors, and the apparatus life reduces or other problems occur, because the pressure difference is generated in the compression vessel, oil is sucked by the high output compressor, or for other reasons.

It is necessary to connect an oil balance pipe having a large diameter to a compressor of high output, in order to solve the imbalance of oil quantity; however, the oil balance pipe becomes complicated, and increases the cost, because an effort is applied to the oil balance pipe when the compressor is started.

Also, in a freezer unit comprising a plurality of compressors of a vessel structure having a low pressure portion and a high pressure portion divided through a discharge port of a compression pump and internal high pressure compressors are installed in parallel, an oil sensor for detecting the oil level surface is installed in respective compressors, and the oil quantity balance of respective compressors is maintained by controlling the oil return quantity from the oil separator based on the state of the oil level surface.

However, the oil sensor is complicated in structure and expensive. In, addition, the oil return control circuit also become complicated and expensive.

[Means for solving the problems]

Therefore, it is necessary to avoid lack of oil in some compressors by a simple composition without cost increase, even if refrigerant compression capacity differs or the passage resistance of the refrigerant discharge pipe differs from one compressor to the other, and it has been the problem to be resolved.

SUMMARY OF THE INVENTION

The present invention intends to solve the problems of the prior art mentioned above, by providing:

a freezer unit of a first composition comprising a single refrigerant circuit where a plurality of internal high pressure type compressors are installed in parallel, wherein an oil separator is installed in a discharged refrigerant junction pipe where refrigerants discharged from respective compressors meet, a first kind of oil return pipe leading to a refrigerant suction pipe of a first compressor from this oil separator is installed, and a second kind of oil return pipe leading to a refrigerant suction pipe of a second compressor from the regular oil level height of the first compressor, a freezer unit of a second composition comprising a refrigerant circuit where a plurality of internal high pressure type compressors is installed in parallel, wherein an oil separator is installed in a discharged refrigerant junction pipe where refrigerants discharged from respective compressors meet, a first kind of oil return pipe provided with an on-off valve in the pipe leading to a refrigerant suction pipe of each compressors from this oil separator is installed, and a second kind of oil return pipe leading to a refrigerant suction pipe of a second compressor from the regular oil level height of the first compressor is installed, a freezer unit of a third composition, wherein the first compressor is a variable compression capacity type compressor in the freezer unit of said first or second composition, a freezer unit of a fourth composition comprising a refrigerant circuit where a plurality of compressors of a vessel structure having a low pressure portion and a high pressure portion divided through a discharge port of a compression pump are installed in parallel, wherein an oil balance pipe provided with a pressure reduction means leading from the high pressure portion of a compressor to a refrigerant suction pipe of another compressor is installed, a freezer unit of a fifth composition comprising a refrigerant circuit where a first compressor of a vessel structure having a low pressure portion and a high pressure portion divided through a discharge port of a compression pump and a second compressor of a high pressure vessel structure are installed in parallel, wherein an oil balance pipe provided with a pressure reduction means leading to a refrigerant suction pipe of the second compressor from the high pressure portion of the second compressor, and an oil balance pipe provided with a pressure reduction means leading to a refrigerant suction pipe of the first compressor from the vicinity of the regular oil level surface of the second compressor is installed, a freezer unit of a sixth composition, wherein one end of the oil balance pipe is connected to the ascending slope portion of a branched refrigerant suction pipe in the freezer unit of said fourth or fifth composition, and a freezer unit of a seventh composition, wherein the refrigerant suction pipe is connected horizontally to the compressor, and one end of the oil balance pipe is connected to a position where a central angle θ on an arc between the refrigerant suction pipe and the oil balance pipe becomes equal or inferior to 45 degrees, at the underside of this refrigerant suction pipe connection part in the freezer unit,

DETAILED DESCRIPTION OF THE PREFERRED EMBODIMENT

First Embodiment

Figure 1:
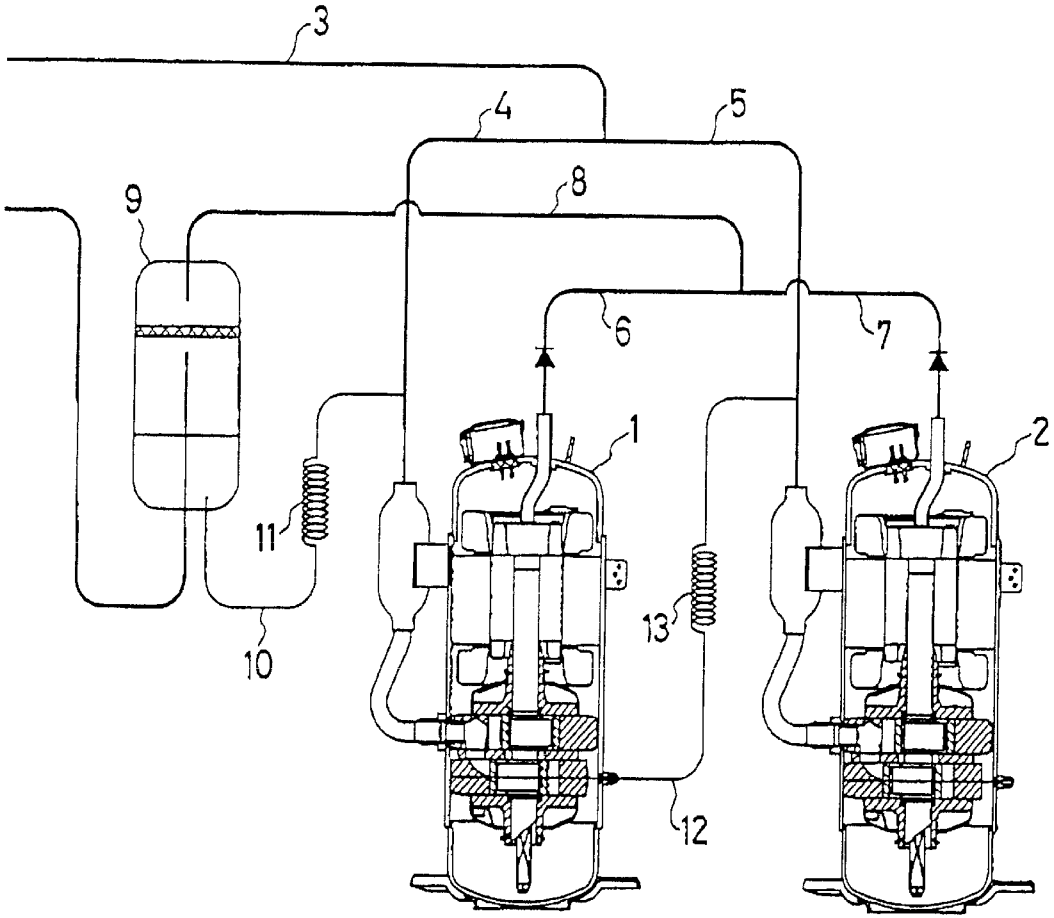
FIG. 1 is an illustration showing a first embodiment of the invention.

Now, a first embodiment of the present invention will be described in detail, based on FIG. 1.

In the drawing, 1 and 2 indicate internal high pressure type compressors composing a freezer unit with not shown condenser, evaporator or others, and installed in parallel in a single refrigerant circuit.

In short, one compressor 1 is connected to one refrigerant suction pipe 4 branching from a refrigerant suction pipe 3, and the other compressor 2 is connected to the other refrigerant suction pipe 5 branching from a refrigerant suction pipe 3. In addition, a refrigerant discharge pipe 6, 7 and a discharged refrigerant junction pipe 8 are installed so that refrigerant compressed by the one compressor 1 is discharged into one refrigerant discharge pipe 6 while refrigerant compressed by the other compressor 2 is discharged into the other refrigerant discharge pipe 7, meet each other, and supply not shown condenser, evaporator or others by circulation.

Then, an oil separator 9 provided with conventionally well-known functions per se is installed in the discharge refrigerant junction pipe 8, a first kind of oil return pipe 10 from this oil separator 9 to the refrigerant suction pipe 4 to which one of compressors 1, 2, for example, compressor 1 provided with a variable refrigerant compressing capability is installed, and a capillary tube 11 as pressure reducing means is installed in the middle of this first kind of oil return pipe 10.

In addition, one end of a second kind of oil return pipe 12 is connected to the level of the regular oil surface of the compressor 1, the other end thereof is connected to the refrigerant suction pipe 5 connected to the compressor 2 of non variable refrigerant compression capability, and a capillary tube 13 as pressure reducing means is installed in the middle of this second kind of oil return pipe 12.

For a full power operation of the freezer unit of the aforementioned composition, both compressors 1, 2 are operated, and for a save operation, with low air-conditioning load, only compressor 1 provided with variable refrigerant compressing capability is operated.

In the freezer unit of the invention, oil discharged to the refrigerant discharge pipe 6, 7 with refrigerant from the compressor 1, 2 is separated from the refrigerant by the oil separator 9. There, oil stored in the oil separator 9 returns first to the compressor 1 through the downstream portion of the first oil return pipe 10 and the refrigerant suction pipe 4 and, further, oil in the compressor 1 positioned higher than the connection portion with the second kind of oil return pipe 12 returns to the compressor 2 through the downstream portion of the second oil return pipe 12 and the refrigerant suction pipe 5.

Moreover, as the compressor 1 side connection area of the second kind of oil return pipe 12 is connected to the oil regular height, oil does not return to the compressor 2 so much as provoking lack of oil in the compressor 1, and oil is not stored excessively in the compressor 1 provoking lack of oil in the compressor 2.

Second Embodiment

Now, a second embodiment of the invention will be described in detail based on FIG. 2.

Figure 2:
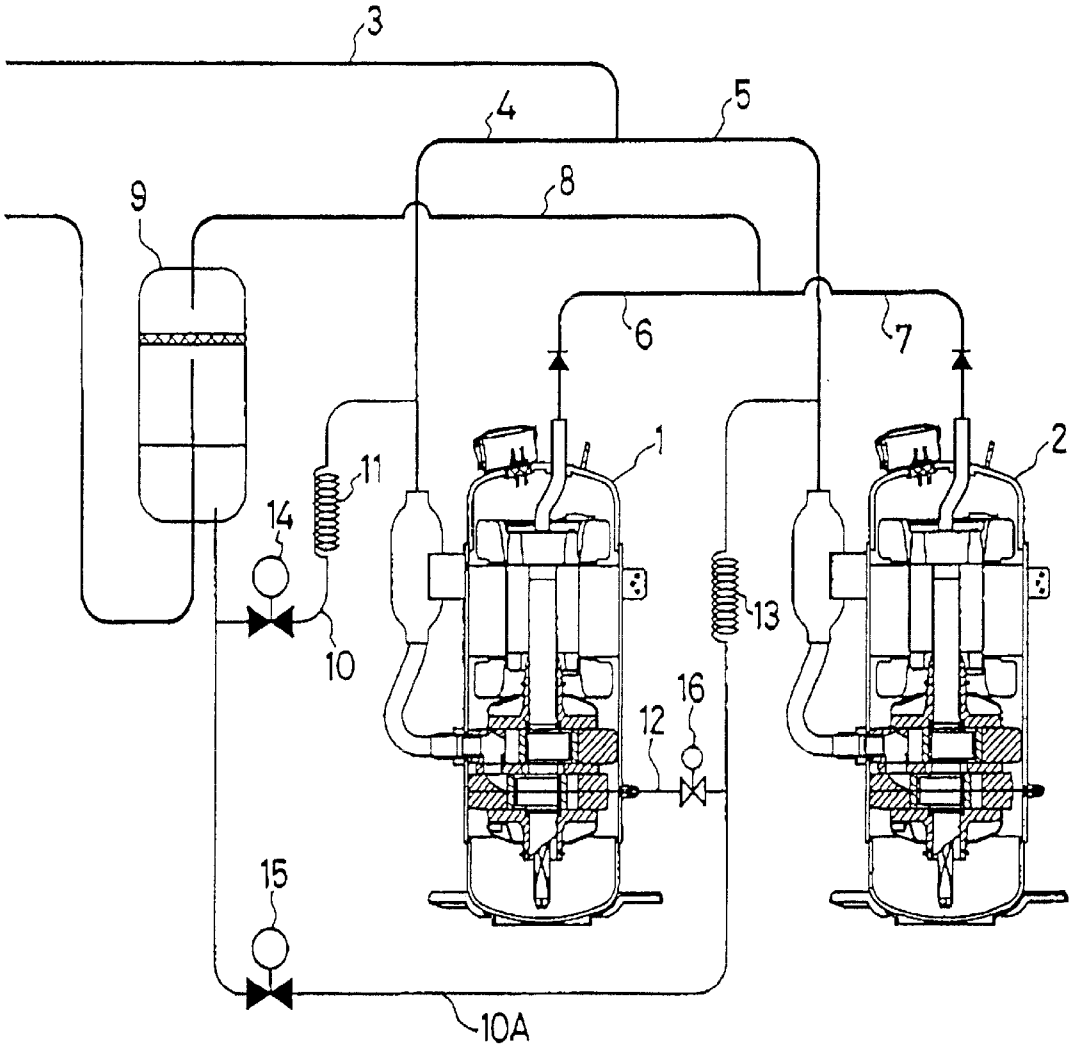
FIG. 2 is an illustration showing a second embodiment of the invention.

In the freezer unit shown in FIG. 2, parts having the same function as the freezer unit shown in said FIG. 1 are indicated by the same symbols so as to facilitate the comprehension.

In the freezer unit shown in this FIG. 2, still another first kind of oil return pipe 10A is installed so as to allow to communicate between the oil separator 9, and the upstream side of the capillary tube 13 of the second kind of oil return pipe 12, and to return oil stored in the oil separator 9 without passing through the compressor 1. In addition, the first kind of oil return pipe 10 is provided with an on-off valve 14 and the first kind of oil return pipe 10A with an on-off valve 15.

For a full power operation of the freezer unit of the aforementioned composition, the on-off valve 14 is opened and the on-off valve 15 is closed to operate both compressors 1, 2, and for the save operation with low air-conditioning load, only one side of the compressor 1 or compressor 2 is operated. At this moment, the on-off valve 14 is opened and the on-off valve 15 is closed for operating only the compressor 1, while the on-off valve 15 is opened and the on-off valve 14 is closed when only the compressor 2 is operated.

Third Embodiment

Now, a third embodiment of the invention will be described in detail based on FIG. 3 and FIG. 4.

In these illustrations showing the third embodiment also, parts having the same function as the freezer unit shown in said drawings are indicated by the same symbols so as to facilitate the comprehension.

The compressor 1, 2 in this embodiment is a low pressure scroll type compressor having a vessel structure, dividing the low pressure portion L and the high pressure portion H through a discharge section P1 of a compression pump P. Further, oil 25 is stored at the bottom of the low pressure portion L for lubrication.

One refrigerant suction pipe 4 branching from a refrigerant suction pipe 3 is connected to the low pressure portion L of the compressor 1, and the other refrigerant suction pipe 5 branching from a refrigerant suction pipe 3 is connected to the low pressure portion L of the compressor 2.

In addition, a refrigerant discharge pipe 6 is connected to the high pressure portion H of the compressor 1, and a refrigerant discharge pipe 7 is connected to the high pressure portion H of the compressor 2, and a discharged refrigerant junction pipe 8 is installed so that high pressure refrigerant discharged into the refrigerant discharge pipe 6, 7 meet each other, and supply not shown condenser, evaporator or others by circulation. Moreover, an accumulator 17 is installed in the refrigerant suction pipe 3, and respective refrigerant discharge pipe 6, 7 is provided with a check valve.

Further, an oil balance pipe 18 is installed from the high pressure portion H of the compressor 1 to the refrigerant suction pipe 5, and a capillary tube 19 as pressure reducing means is installed in the middle of this oil balance pipe 18. In addition, an oil balance pipe 20 is installed from the high pressure portion H of the compressor 2 to the refrigerant suction pipe 4, and a capillary tube 21 as pressure reducing means is installed in the middle of this oil balance pipe 20.

Figure 4:
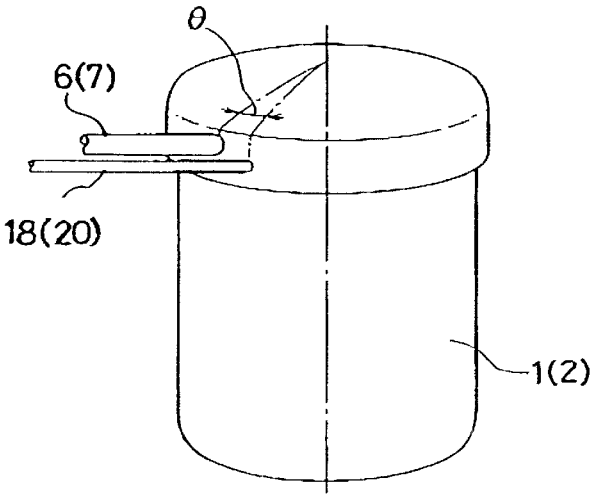
FIG. 4 is an illustration showing essential parts of the third embodiment.

Here, the refrigerant discharge pipe 6, 7 is connected horizontally to the compressor 1, 2, as shown in FIG. 4, and one end of the oil balance pipe 18, 20 is connected thereunder. At this moment, the refrigerant discharge pipe 6 and the oil balance pipe 18, or the refrigerant discharge pipe 7 and the oil balance pipe 20 are both connected at a position where the central angle θ becomes equal or inferior to 45 degrees.

The other end of the oil balance pipe 18, 20 is connected to the ascending slope portion of the refrigerant suction pipe 4, 5 branched from the refrigerant suction pipe 3.

In the freezer unit of the aforementioned composition, in both of compressors 1, 2, oil 25 that has lubricated the sliding parts of the compression pump P is discharged into the high pressure portion H with compressed refrigerant, and if there is some space in this high pressure portion H, oil 25 is separated from the refrigerant therein, and accumulates at the bottom of the high pressure portion H.

High pressure refrigerant compressed by the compression pump P and supplied to the high pressure portion H from the discharge section P1 is discharged into the refrigerant discharge pipe 6, 7, therefore, it flows much from the discharge portion P1 to the connection part of the refrigerant discharge pipe 6, 7, and oil 25 separated from the refrigerant accumulates more at the bottom of this passage.

Then, and one end of the oil balance pipe 18, 20 is connected to this portion, oil 25 accumulated in the high pressure portion H of the compressor 1 is sucked in the low pressure portion L of the compressor 2 with refrigerant gas through the oil balance pipe 18 and the refrigerant suction pipe 5, oil 25 accumulated in the high pressure portion H of the compressor 2 is sucked in the low pressure portion L of the compressor 1 with refrigerant gas through the oil balance pipe 20 and the refrigerant suction pipe 4, 5, and added to oil 25 accumulated at the respective bottom.

At this moment, only oil 25 that has lubricated the sliding parts of respective compression pump P and is discharged in the high pressure portion H thereof is supplied from the compressor 1 to the compressor 2, and from the compressor 2 to the compressor 1, and oil 25 accumulated in the low pressure portion L is not taken out; therefore, even when the refrigerant compression capability is different for the compressors 1, 2, oil 25 is prevented from being accumulated excessively in any one of compressors 1, 2, and from being insufficient in the other compressor.

When one compressor, for instance the compressor 1 is in operation, and the other compressor 2 is stopped, as refrigerant gas does not flow to the compressor 2 through the refrigerant suction pipe 5, oil 25 that has lubricated the sliding parts of the compression pump P and is discharged in the high pressure portion H of the compressor 1, and accumulated in the bottom thereof is sucked into the compressor 1 with refrigerant gas through the oil balance pipe 18, a part of the refrigerant suction pipe 5 and the refrigerant suction pipe 4. Therefore, the compressor 1 is prevented from being short of oil.

Moreover, as the refrigerant suction pipe 6 and the oil balance pipe, and the refrigerant suction pipe 7 and the oil balance pipe 20 are mounted on the compressor 1, 2 in a close state so that the central angle θ becomes equal or inferior to 45 degrees respectively, oil 25 separated in the high pressure portion H of the compressor 1 is supplied effectively to the low pressure portion L of the compressor 2 and oil 25 separated in the high pressure portion H of the compressor 2 is supplied effectively to the low pressure portion L of the compressor 1, respectively.

Fourth Embodiment

Now, a fourth embodiment of the invention will be described in detail based on FIG. 5.

In these illustrations showing the fourth embodiment also, parts having the same function as the freezer unit shown in said drawings are indicated by the same symbols so as to facilitate the comprehension.

Figure 3:
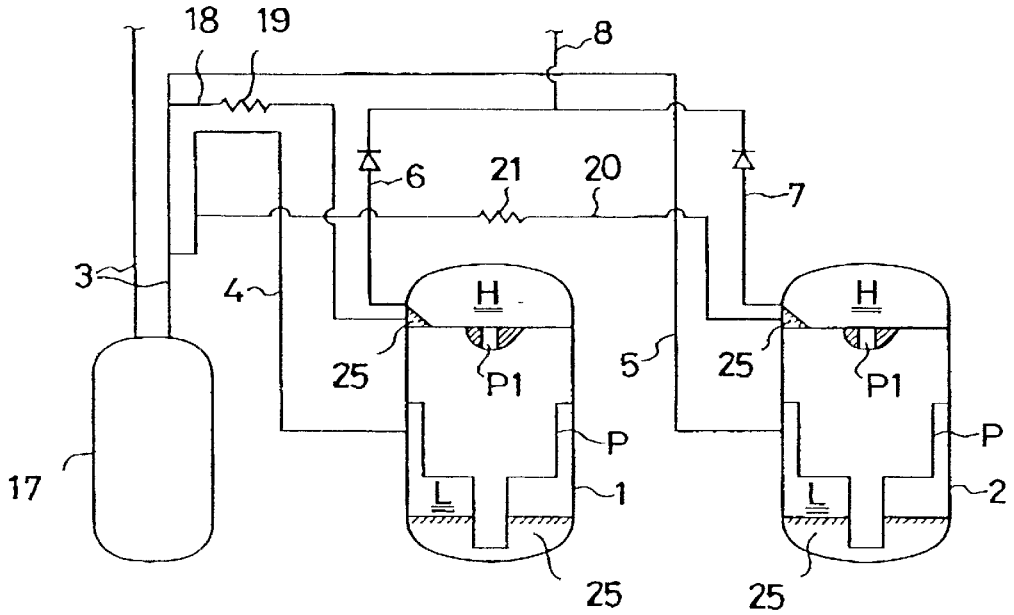
FIG. 3 is an illustration showing a third embodiment of the invention.
Figure 5:
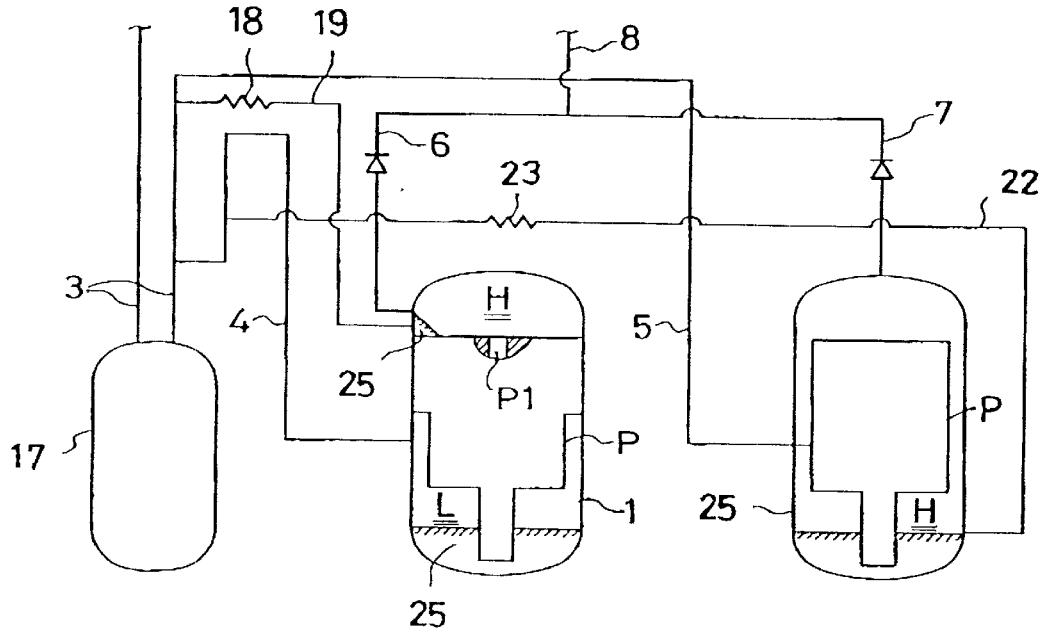
FIG. 5 is an illustration showing a fourth embodiment of the invention.

The freezer unit shown in this FIG. 5 is a freezer unit where a compressor 1 of low pressure scroll type of the same structure as the compressor 1, 2 shown in said FIG. 3, and a compressor 2 of internal high pressure type of the same structure as the compressor 1, 2 shown in said FIG. 1, FIG. 2 are arranged in parallel to the refrigerant pipe.

And, in this freezer unit, the high pressure portion H of the compressor 1 and the refrigerant suction pipe 5 are connected by an oil balance pipe 18 provided with a capillary tube 19, and the vicinity of the regular oil level surface of the compressor 2 and the refrigerant suction pipe 4 are connected by an oil balance pipe 22 provided with a capillary tube 23.

In the freezer unit of the aforementioned composition also, oil 25 that has lubricated the sliding parts of the compression pump P is discharged into the high pressure portion H with compressed refrigerant, and accumulated at the bottom of this high pressure portion H. Then, oil 25 accumulated in the high pressure portion H of the compressor 1 is sucked in the low pressure portion L of the compressor 2 with refrigerant gas through the oil balance pipe 18 and the refrigerant suction pipe 5, and a part of oil 25 mixed into the compression gas is discharged into the refrigerant discharge pipe 7 with refrigerant gas, but oil 25 separated in the high pressure portion H accumulates at the bottom thereof, and is supplied to respective sliding parts.

On the other hand, oil 25 accumulated in the high pressure portion H of the compressor 2 is sucked in the low pressure portion L of the compressor 1 with refrigerant gas through the oil balance pipe 20 and the refrigerant suction pipe 4 and oil 25 accumulated at the bottom is supplied to respective sliding parts.

In the freezer unit of the structure shown in FIG. 5, as the high pressure portion H of the compressor 1 of low pressure scroll type is connected through the oil balance pipe 18, only oil 25 separated from the refrigerant is supplied from the compressor 2 to the compressor 1, and a quantity of oil 25 accumulated in the low pressure portion L is not sucked even if the capacity of the compressor 2 is large, and therefore, the compressor 1 is prevented from being short of oil 25.

Similarly, for the oil 25 accumulated in the high pressure portion H of the compressor 2, oil 25 at the position lower than the regular oil level surface is not sucked by the compressor 1 through the oil balance pipe 22, because the oil balance pipe 22 is connected to the vicinity of the regular oil level surface; therefore, the compressor 2 is also prevented from being short of oil 25.

The invention is not limited to the embodiments shown and described herein; accordingly, various modifications may be made without departing from the spirit or scope as defined by the appended claims.

For instance, in any of freezer unit of the first embodiment shown in FIG. 1, freezer unit of the second embodiment shown in FIG. 2 and freezer unit of the third embodiment shown in FIG. 3, the freezer unit can be composed by installing three or more compressors in parallel.

In short, in the freezer unit of the first embodiment shown in FIG. 1, when n (n>=3) compressors in total are installed, a second kind of oil return pipe is installed further up to the second kind of oil return pipe 12 leading to the n-th compressor from the (n−1)-th compressor.

Also, when n (n>=3) compressors in total are installed in the freezer unit of the second embodiment shown in FIG. 2, a first kind of oil return pipe providing with an on-off valve leading to the refrigerant suction pipe of all compressors from the oil separator and, at the same time, a second kind of oil return pipe is installed up to the second kind of oil return pipe leading the n-th compressor from the (n−1)-th compressor.

In addition, an on-off valve 16 may be disposed in the second kind of oil return pipe 12 and the on-off valve 14 is opened and the on-off valves 15, 16 are closed for operating only the compressor 1, the on-off valve 15 is opened and the on-off valves 14, 16 are closed when only the compressor 2 is operated and the on-off valves 14, 16 are opened and the on-off valve 15 is closed to operate both compressors.

Moreover, when n (n≧3) compressors in total are installed in the freezer unit of the third embodiment shown in FIG. 3, an oil balance pipe provided with a pressure reducing means in the pipe leading to the refrigerant suction pipe of the second compressor from the high pressure portion of the first compressor is installed, an oil balance pipe provided with a pressure reducing means in the pipe leading to the refrigerant suction pipe of the third compressor from the high pressure portion of the second compressor is installed, an oil balance pipe provided with a pressure reducing means in the pipe leading to the refrigerant suction pipe of the n th compressor from the high pressure portion of the n−1 th compressor is installed similarly and sequentially, and further, an oil balance pipe provided with a pressure reducing means in the pipe leading to the refrigerant suction pipe of the first compressor from the high pressure portion of the n th compressor is installed.

In addition, in the compressors 1, 2 shown in FIG. 3 and the compressor shown in FIG. 5, an oil separation plate may be disposed in the high pressure portion, H and the refrigerant suction pipe and the oil balance pipe may be disposed at a position where the central angle θ becomes equal or inferior to 45 degrees.

It is also possible to combine the piping composition shown in FIG. 3, and the piping composition shown in FIG. 5.

As above-described, since any of a plurality of compressors installed in series according to the present invention do not cause lack of oil, there are not cases where a particular compressor falls into lack of lubricant and a sliding part wears to make the lifetime of a unit short.

Especially, according to the third invention, the compressor operation time can be balanced, because the compressor to be operated for a partial load can be selected freely.

In addition, according to the sixth invention, oil can be received or delivered between compressors in operation independently of the stopped compressor, because one end of the oil balance pipe is connected to the upstream section installed on the ascending slope portion of the refrigerant suction pipe.

Further, according to the seventh invention, oil accumulated near the refrigerant discharge pipe connection part is supplied effectively to the other compressor through the oil balance pipe, as the refrigerant suction pipe and the oil balance pipe approach so that the central angle θ becomes equal or inferior to 45 degrees, and, the oil balance pipe is connected to the underside of the refrigerant discharge pipe.

What is claimed is:

1. A freezer unit comprising:

a refrigerant circuit where a plurality of internal high pressure type compressors are installed in parallel;

an oil separator is installed in a discharged refrigerant junction pipe where refrigerants discharged from respective compressors meet;

a first kind of oil return pipe leading to a refrigerant suction pipe of a first compressor from the oil separator is installed; and a second kind of oil return pipe leading to a refrigerant suction pipe of a second compressor from the regular oil level height of the first compressor is installed.

2. A freezer unit comprising:

a refrigerant circuit where a plurality of internal high pressure type compressors are installed in parallel;

an oil separator is installed in a discharged refrigerant junction pipe where refrigerants discharged from respective compressors meet;

a first kind of oil return pipe provided with an on-off valve in the pipe leading to a refrigerant suction pipe of each compressor from the oil separator is installed; and a second kind of oil return pipe leading to a refrigerant suction pipe of a second compressor from the regular oil level height of the first compressor is installed.

3. The freezer unit of claim 1, wherein:

a first of the compressors is a variable compression capacity type compressor.

4. A freezer unit comprising:

a refrigerant circuit where a plurality of compressors of a vessel structure having a low pressure portion and a high pressure portion divided through a discharge port of a compression pump are installed in parallel; and an oil balance pipe provided with pressure reduction means leading from the high pressure portion of a compressor to a refrigerant suction pipe of another compressor is installed.

5. A freezer unit comprising:

a refrigerant circuit where a first compressor of a vessel structure having a low pressure portion and a high pressure portion divided through a discharge port of a compression pump and a second compressor of a high pressure vessel structure are installed in parallel;

a first oil balance pipe provided with pressure reduction means leading to a refrigerant suction pipe of the second compressor from the high pressure portion of the first compressor is installed; and a second oil balance pipe provided with pressure reduction means leading to a refrigerant suction pipe of the first compressor from the vicinity of the regular oil level surface of the second compressor is installed.

6. The freezer unit of claim 4, wherein:

one end of the oil balance pipe is connected to an ascending slope potion of the refrigerant suction pipe that is branched.

7. The freezer unit of claim 4, wherein:

a refrigerant discharge pipe is connected horizontally to the compressors, and one end of the oil balance pipe is connected to a position where a central angle on an arc between the refrigerant discharge pipe and the oil balance pipe becomes equal or inferior to 45 degrees, at the underside of a connection part for the refrigerant discharge pipe.

8. The freezer unit of claim 2, wherein:

a first of the compressors is a variable compression capacity type compressor.

9. The freezer unit of claim 5, wherein:

one end of the oil balance pipe is connected to an ascending slope portion of the refrigerant suction pipe that is branched.

10. The freezer unit of claim 5, wherein:

a refrigerant discharge pipe is connected horizontally to the compressors, and one end of the oil balance pipe is connected to a position where a central angle on an arc between the refrigerant discharge pipe and the first and second oil balance pipes becomes equal or inferior to

45 degrees, at the underside of a connection part for the refrigerant discharge pipe.

11. The freezer unit of claim 6, wherein:

a refrigerant discharge pipe is connected horizontally to the compressors, and one end of the oil balance pipe is connected to a position where a central angle on an arc between the refrigerant discharge pipe and the first and second oil balance pipes becomes equal or inferior to 45 degrees, at the underside of a connection part for the refrigerant discharge pipe.

* * * * *

UNITED STATES PATENT AND TRADEMARK OFFICE

CERTIFICATE OF CORRECTION

PATENT NO. : 6,446,462 B1
DATED : September 10, 2002
INVENTOR(S) : Yasunori Kiyokawa et al.

It is certified that error appears in the above-identified patent and that said Letters Patent is hereby corrected as shown below:

Column 2,
Line 58, "unit," should read -- unit, as concrete means to solve problems of the aforementioned prior art. --.

Signed and Sealed this

Sixteenth Day of December, 2003

JAMES E. ROGAN
*Director of the United States Patent and Trademark Office*